US007836524B2

(12) United States Patent
Muench

(10) Patent No.: US 7,836,524 B2
(45) Date of Patent: Nov. 23, 2010

(54) EQUESTRIAN RIDING GARMENT

(76) Inventor: Susan Marie Muench, 1 Bluegrass Ave., Ft. Wright, KY (US) 41011

( * ) Notice: Subject to any disclaimer, the term of this patent is extended or adjusted under 35 U.S.C. 154(b) by 126 days.

(21) Appl. No.: 12/002,450

(22) Filed: Dec. 17, 2007

(65) Prior Publication Data

US 2009/0151038 A1 Jun. 18, 2009

(51) Int. Cl.
*A41D 13/02* (2006.01)

(52) U.S. Cl. ..... 2/227; 2/231; 2/232

(58) Field of Classification Search ..... 2/227, 2/228, 231, 232, 456, 455
See application file for complete search history.

(56) References Cited

U.S. PATENT DOCUMENTS 3,508,530 A * 4/1970 Clawson ..... 123/275
3,800,330 A * 4/1974 Bowcut ..... 2/227
4,506,391 A * 3/1985 Rodman ..... 2/227
4,843,654 A * 7/1989 March ..... 2/227
5,033,124 A * 7/1991 Bucalo et al. ..... 2/227
D420,492 S * 2/2000 Tannenbaum ..... D2/860

* cited by examiner

*Primary Examiner*—Gloria Hale
(74) *Attorney, Agent, or Firm*—R. Christian Macke

(57) ABSTRACT

A lower body equestrian garment is provided. Sections of gripping, protective fabric are provided on the inner portions of the legs extending from inner thigh to ankle. The gripping/protective fabric has flared sections near the bottom, and slots for receiving and retaining spurs worn by the rider. Zippers are provided on the outer legs allowing quick removal of the lower body garment to improve comfort of the rider when not riding. An adjustable waistband is provided to allow the lower body garment to be adaptable to the differently sized individuals.

13 Claims, 4 Drawing Sheets

EQUESTRIAN RIDING GARMENT

FIELD OF THE INVENTION

This invention relates to an equestrian riding garment, and more particularly to a lower body garment combining breeches and half-chaps.

BACKGROUND OF THE INVENTION

Horseback riding is both a popular past-time and competitive sport, and it is desirable to construct apparel used for horseback riding to be both fashionable and utilitarian. Depending on the nature of the riding, the clothing can take decidedly different forms. For example, the apparel worn by thoroughbred jockeys looks and performs differently from apparel worn by working cowboys leading cattle drives across the plains. Ease of movement and comfort for the long term affect and reflect the different considerations for a wide variety of different forms of horseback riding. The silks worn by thoroughbred jockeys allow complete freedom of movement and provide very little padding or protection for the rider, who will only be on the horse for a few minutes and will be directing the horse to run at full speed with only a small portion of the jockey's leg in contact with the horse. The cattle-driving cowboy, on the other hand, will be on the horse for hours or days directing the horse to walk or gallop. As a result, protection offered by heavy, rugged chaps which cover substantially the entire legs of the cowboy and are constructed from heavy, inflexible leather, are worn for that purpose and do not offer ease of movement for the rider. This is protection from the elements, not necessary for the modern competing or pleasure riding equestrian.

Another popular form of recreational and competitive horseback riding is English, which in itself comprises a number of subcategories. In English-style equestrian sports, such as steeplechase and dressage, a rider guides a horse through a variety of maneuvers. In steeplechase, for example, a rider guides his horse through a series of jumps and hurdles, while in dressage riding the rider performs a series of graceful dance-type maneuvers. The English rider will need to be free to move, while also needing to have fabric and provisions within the lower body garments to provide grip, sufficient padding and protection between the rider and the horse.

Another consideration for apparel worn by the modern day equestrian is the need to make such clothing easy to put on and take off. Typically, the modern equestrian, in addition to riding, will be involved in grooming and bathing his horse and will also perform chores like mucking out the stall. For the English-style rider that is outfitted with functional apparel providing grip, padding and protection, the grooming and bathing of the horse can be unpleasant, particularly in warm weather.

English riders typically wear three articles of apparel below the waist providing grip, padding and protection. Breeches, essentially pants extending from waist to ankle with sections of leather or suede lining the inner legs from about the knee upwardly to the inner thigh, provide protection from blistering or chaffing for the rider on the upper portion of his legs. On the lower portions of the legs, an English rider wears half chaps, which are essentially boot extensions that are worn over the lower legs and calves and extend from the tops of ankle high boots up to the knees. The half chaps are held down on the lower legs and prevented from riding up over the knee by a strap that extends under the instep of the boot and engages the half chaps on opposed sides, the inner leg side and the outer leg side. In addition, the straps prevent the half chaps from twisting around the rider's leg. Generally, the half chaps are made of leather and, similar to the breeches, are used to protect the rider's inner legs from blistering or chaffing caused by rubbing.

The layer of the breeches and the half chaps makes the rider uncomfortably hot and does not serve any purpose during the grooming and bathing of the horse. Since most modern equestrians do not have a groom to hot walk and bathe their horse while they change into shorts and cool down, the equestrian cares for the horse in his riding apparel, including the breeches with leather lined inner legs and half chaps. It is thus desirable to provide riding apparel that is easily put on or taken off so that, particularly in warm weather, the rider can remove the outer protective garments without ever leaving the horse, then bathe the horse, and then perform other chores around the stables.

The combination of the half chaps and breeches provide protection for the English rider's inner legs from thigh to ankle, but there are significant disadvantages to the prior art arrangement. For example, there are three separate items of apparel that must be put on and taken off by the rider; the leather lined breeches and the half chaps worn on each leg. The breeches are pulled on, and the half chaps are zipped on, usually up the side or back, over the portion of the breeches below the knee. Thus, there is significant time and effort involved in putting these lower body garments on and taking them off.

In addition, while the breeches provide the protection for the inner knees and/or thighs, the lower portion of the breeches below the knees is tucked into and worn under the half chaps. However, while each of the half chaps has a strap extending under the boot to hold them down and prevent twisting, the breeches have no such straps. The breeches, because they are not held down, can ride up and get twisted on the rider's legs under the half chaps.

Another disadvantage of the existing apparel is that the half chaps often do not fit over the tops of the rider's ankle-high boots. Snugly fitting half chaps also do not fit over the tops of a rider's heavy, winter work boots or cold weather riding boots, resulting in a situation where the rider must either buy separate tall winter boots for riding, or bring two pairs of boots; first, a summer style boot that fits under the half chaps to ride, and, second, a warm, bulky, insulated boot to wear while caring for the horse and stable. The problems with such an arrangement is that wearing the summer style boot allows the rider's feet to get cold while riding, but the insulated boot is not compatible with the half chaps, and cannot be used while riding. It is thus desirable to provide means for gripping, padding and protecting the rider that fits over any size boot, regardless of how thickly padded the boot is. One important feature to provide for such is an adjustable strap that goes under the rider's boot, regardless of the boot size.

Part of the performance of riding is the rider's use of spurs, worn on the rider's heels at ankle height, which direct the horse to turn right or left or speed up or lengthen his stride. The spurs comprise metal frames worn over the rider's boots that have a short nub extending rearwardly from the rider's heel. The spurs are used by the rider to send an appropriate signal to the horse to, for example, move right or left, or speed up, by the rider turning his toe out slightly, and giving a tap or a series of taps to communicate with the horse. A common problem with spurs is that they are mounted on the back side of the rider's boots over the half chaps, with the half chaps covering the part of the boot known as the spur rest located on the back side of the boot at ankle height. Because a rider moves up and down with the horse while riding or performing, the spurs frequently slip down off of the heel, requiring the rider to raise his heel to communicate with the horse. In the prior art, the spur just sits on the spur rest on the typical paddock boot or tall boot and it can easily slide off. "Heels down" is a descriptive term used by equestrians because riding with the heels down is the only safe position for a rider. That is, if the rider has to raise his heel to make contact with the horse's side to give a signal, the rider is at risk of his foot slipping through the stirrup and getting stuck. Besides frustrating the rider's capacity to communicate to the horse, raising the heels has been the cause of many riders being dragged and seriously injured or killed. It is thus desirable to provide equestrian riding apparel that promotes a safe leg position by having provisions to keep the spurs in place on the back of the boot at ankle height. This benefit may be provided by a spur support incorporated in the garment that surrounds the spur to prevent it from sliding down off of the heel.

It is desirable to provide riding apparel for the equestrian rider that provides a single lower body garment that solves all of the disadvantages of the above described riding apparel, while serving the function of protecting the inside of the rider's legs. The inventive garment is quickly and easily put on and taken off, allowing a rider to work in the stables and on grooming his horse without soiling the protective apparel and without making the rider uncomfortably hot in warm weather. In addition, the inventive garment, comprising a single lower body garment, simplifies the preparation by the rider by replacing the step-by-step process of pulling on breeches, then putting on his paddock boots, then putting on his half chaps (and the opposite process for removal) with a process of putting on the inventive garment and quickly affixing it to itself along the outside of the rider's legs and around the rider's waist, regardless of what type of shoe or boot the rider is wearing. The inventive garment is preferably a two piece ensemble, comprising protective outer garment for riding, and an active wear under garment that remains after the padded, protective garment is removed. The garments are made of 4 way stretch material to allow maximum flexibility for the agile rider. This flexibility is also beneficial when putting protective sports boots on the horse's legs or dressing on the horse's hooves, or caring for his hooves, or any other activities requiring walking or running with the horse, like when taking horses out to pasture. For riders that work in exchange for boarding fees, they spend more time leading dozens of horses out to designated pastures, walking or jogging for hours, than they do riding. In that situation, easing the difficulties of putting on and taking off the padded protective riding garment is particularly advantageous.

The inventive garment eliminates the need for half chaps while also accounting for twisting of the garment on the rider's legs while riding, providing a heavy fabric that flares out as it approaches the bottom of the garment. The heavy fabric, on the inside of a rider's legs, is protective and padded, while also being secured to 4 way stretch fabric allowing maximum flexibility for the rider. In addition, the inventive garment is provided with an opening on the rear of the rider's heel at ankle height, that holds the rider's spur in place, preventing it from slipping and eliminating the need for the rider to raise his heel.

The inventive garment provides all of these benefits while eliminating the need for half chaps. It is also provided with means for adjusting the waist and the under boot straps to accommodate different size riders and boots.

OBJECTS OF THE INVENTION

It is an object of the present invention to provide a single lower body equestrian riding garment that provides padding along the length of the rider's legs from about the knee to ankle and protective fabric from thigh to ankle.

It is another object of the present invention to provide a lower body equestrian riding garment that eliminates the need for protective half chaps or tall boots to protect the rider's lower legs.

It is yet another object of the present invention to provide a lower body equestrian riding garment comprising a combination of at least three differing fabrics: a freely stretching fabric, a heavy fabric and a padding type fabric, sewn together to create a garment that is both conducive to movement and protective along the rider's inner legs.

It is a further object of the present invention to provide a lower body equestrian riding garment having provisions for quick attachment and removal comprising fastening mechanisms along the outside of the rider's legs and around the rider's waist.

It is a further object of the present invention to provide a lower body equestrian riding garment having a removable and adjustable securing strap extending under the rider's instep to hold the garment down and to prevent twisting of the garment which does not limit the rider to an non insulated, summer riding boot.

It is yet another object of the present invention to provide a lower body equestrian riding garment having provisions for engaging and holding spurs extending outwardly from the rear of rider's heels which prevent the spurs from slipping down off of the heels.

It is another object of the present invention to provide a lower body equestrian riding garment having padded, protective sections of fabric along the inner portions of the legs that are flared near the bottom of the garment.

It is yet another object of the present invention to provide a means for adjusting the size of the waist and the straps extending under the boots to accommodate different size riders and boots.

These and other objects and advantages of the present invention will be apparent from a review of the following specification and accompanying drawings.

SUMMARY OF THE INVENTION

The present invention provides a lower body equestrian riding garment having at least two sections of fabric extending substantially the entire length of a rider's two legs. These two sections of fabric have padded protective sections of fabric along the inner sections of both legs extending substantially the length of the inner legs.

The padded protective sections of the lower body garment comprise sections of either leather or ultrasuede affixed to the inner legs. The gripping/protective sections of the lower body garment comprise flared sections near the bottom in the most preferred embodiment of the invention.

The base layer of fabric of the lower body garment of the present invention comprises freely stretching fabric conducive to movement by the rider. The padded protective sections of fabric are affixed to the flexible freely stretching fabric.

The lower body garment of the present invention comprises freely stretching fabric as a base layer that surrounds substantially all of a rider's legs from thigh to ankle and padded protective sections comprising heavy durable fabric sewn to inner portions of the legs of the flexible fabric. Padding is sandwiched between the flexible fabric and the heavy durable fabric. The lower body garment also has adjustable means for quickly and easily affixing and removing the garment to and from a rider. The adjustable means for affixing and removing comprises means for quickly and easily affixing and removing the garment around a rider's waist. In the most preferred embodiment, the affixation means around a rider's waist comprises hook and loop connectors. The adjustable means for affixing and removing also comprises an interlocking buckle and lengths of hook and loop connectors sufficient to adjust the waist size to accommodate a wide variety of body types.

The lower body garment of the present invention also has means for quickly and easily affixing and removing the garment along the lengths of the rider's legs, specifically comprising zippers positioned near the outside of the rider's legs.

Finally, the lower body garment of the present invention has an opening near the bottom rear of each of the legs to receive a spur worn by a rider.

DETAILED DESCRIPTION OF THE INVENTION

Figure 1:
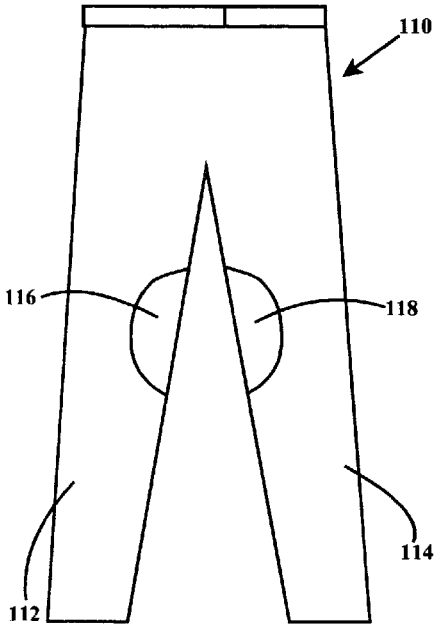
Figure 1 PRIOR ART
FIG. 1 is an illustration of prior art breeches having a protective patch on the inner leg.

The lower body garment 10 of the present invention comprises a single article of clothing worn by an equestrian. The utilitarian features of the lower body garment 10, set forth in more detail herein, are particularly advantageous to a rider of a horse requiring flexibility and freedom of movement. Without limitation, the lower body garment 10 is well suited to English style riders such as competitive dressage riders, eventers, hunters and jumpers.

The lower body garment 10 has two sections comprising pant legs 12, 14 that cover the rider from waist to ankles. The legs 12, 14 of the garment 10 are distinctive by the provision of gripping/protective fabric sections 16, 18 located on the inner portion of the legs 12, 14. The gripping/protective fabric sections 16, 18 comprise a second layer of fabric, such as leather or suede in the most preferred embodiment, sewn onto a base layer of fabric, such as a 4 way stretch polyester/lycra material. In the most preferred embodiment of the present invention, the gripping/protective fabric sections 16, 18 comprise two uninterrupted lengths of material for each leg 12, 14, but it is specifically contemplated that the gripping/protective fabric sections 16, 18 may be subdivided into multiple sections without departing from the principles of the present invention. Another feature of the present invention is the inclusion of gripping/protective fabric on the inner legs extending substantially from inner thigh to ankle. The gripping/protective fabric sections 16, 18, in the most preferred embodiment of the present invention, comprise leather or suede and provide good grip for the rider's legs to hold onto the horse with his legs. Also, in the most preferred embodiment of the present invention, the gripping/protective fabric sections 16, 18 are padded, the padding being placed between the gripping/protective fabric and the underlying 4 way stretch material, at least in part, to provide the rider comfort and protection from friction to his inner leg resulting from contact with the saddle and horse.

Prior art equestrian gear worn by an English rider is generally illustrated at FIGS. 1-5. Breeches 110 are essentially pants worn by an English rider. The prior art breeches 110 include protective patches 116, 118 on the legs 112, 114 of the breeches 110.

Figure 2:
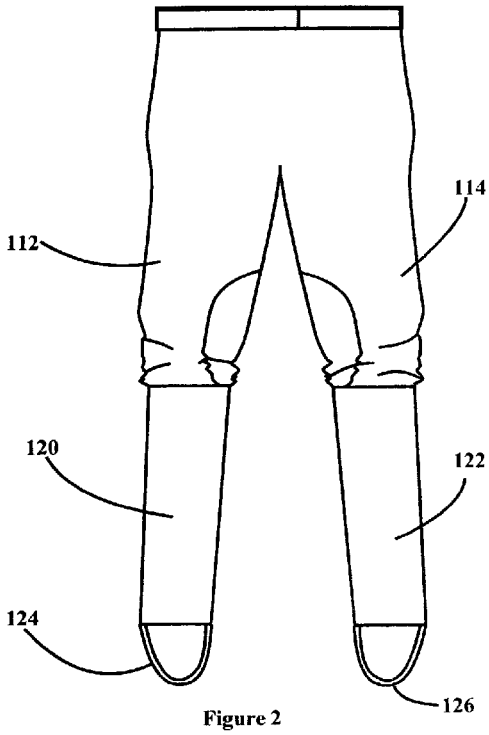
Figure 2 PRIOR ART
FIG. 2 is an illustration of a prior art combination of breeches and half chaps.
Figure 3:
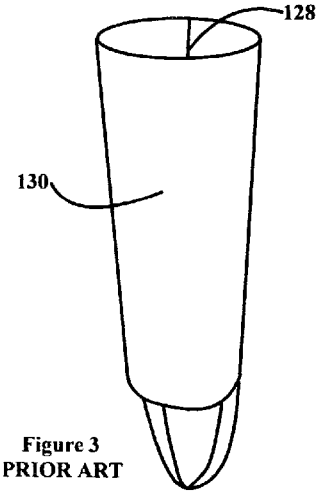
Figure 3 PRIOR ART
FIG. 3 is an illustration of prior art half chaps with zippers on the outside and an under boot strap.
Figure 4:
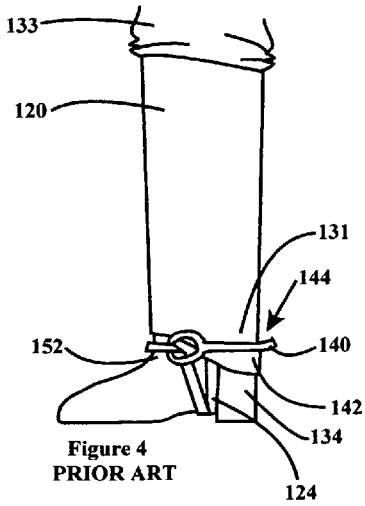
Figure 4 PRIOR ART
FIG. 4 is an illustration of the prior art combination of half chaps with boots, and spurs that ride on top of the half chaps.

The prior art breeches 110 are worn in combination with half chaps 120, 122 (see FIG. 2). The half chaps 120, 122 comprise leather leg wraps from about the ankle to just below the knee to give a rider protection and grip on his lower legs that engage the horse during a ride. Prior art half chaps 120, 122 have retention straps 124, 126 that hold the half chaps 120, 122 down on the lower portion of a rider's legs while riding. Prior art half chaps 120, 122, illustrated by typical half chap 130 in FIG. 3, also have either a zipper or hook and loop connectors along a seam 128 allowing a rider to put them on after his boots and then zip them up or fasten them together The half chap 120 is worn as shown in FIG. 4 by a rider, substantially covering the portion of the rider's leg from ankle 131 to knee 133. The strap 124 extends under the rider's boot 134 to hold the half chap 120 down on the rider's leg; otherwise the up and down movement of the rider and inward pressure of the leg exerted by a rider would cause the half chap 120 to ride up on the leg.

Figure 4B:
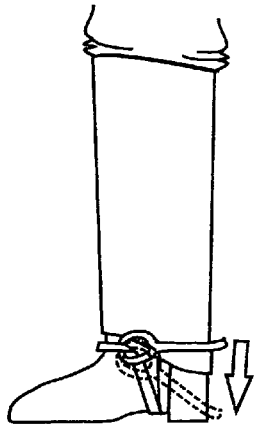
Figure 4B PRIOR ART
FIG. 4B is a detailed view showing how the spur falls while riding.
Figure 4A:
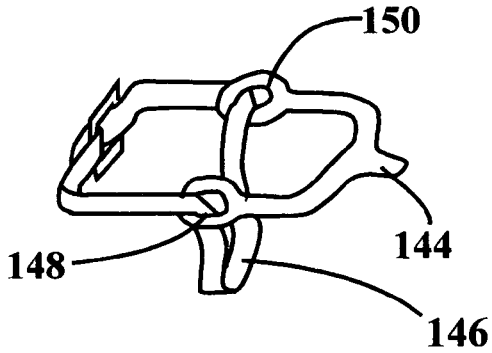
FIG. 4A is a detailed view of the spur.
Figure 5:
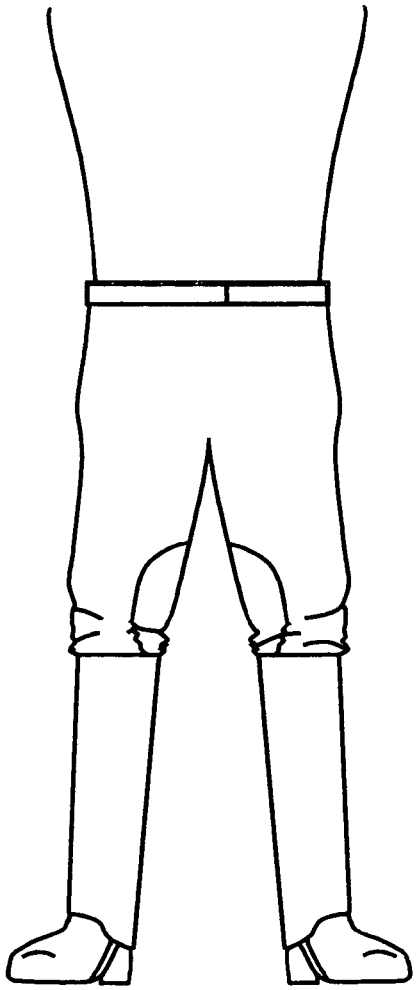
Figure 5 PRIOR ART
FIG. 5 is a prior art combination worn by a rider comprising breeches and half chaps over boots.
Figure 6:
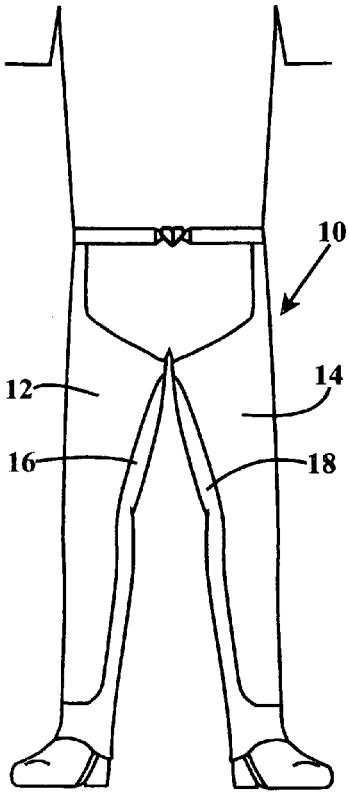
FIG. 6 is an illustration of the lower body garment of the present invention as worn by a rider.

A spur 144 is worn by an equestrian to provide a means for communicating directions to the horse. That is, a rider uses a spur 144, positioned on or near the rear of the boot 134 atop a small leather nub 142 known as the spur rest, to signal the horse him to go right or left or to speed up or slow down, for example. The spur 144 has an extended nub 140 on an angled piece of metal, such as that shown in FIG. 4A. The spur 144 is held on to a rider's boot 134 with a strap 146 that loops through two eyes 148, 150 of the spur 144, and extends under the boot 134 (FIG. 4). The strap 146 buckles to itself near the bridge 152 of the boot 134. It is a significant problem, however, that the spur 144 often slips down off the spur rest 142 in the direction depicted in FIG. 4B, requiring the rider to raise his heels to use the spur 144 in the intended manner, to signal the horse to do something. Spur rests 142 are problematic and often ineffective to keep the spur properly positioned, but when half chaps are worn, they are completely useless for that purpose, insofar as they are covered up by the half chaps. This can be dangerous because, as the rider lifts his leg to get the fallen spur 144 to a position to signal the horse, the chances of the rider's foot slipping through and getting stuck in the stirrups increases, presenting a safety concern. It is a frequent source of injury and, at times, even death, when a rider falls off of a horse and is dragged with his boot and/or spur entangled in the stirrups.

The present invention, as described in more detail herein, is particularly advantageous over this aspect of the prior art. Specifically, the prior arrangement wherein spurs are worn over the half chaps, which are worn over the paddock boots, requires removal of two spurs, then two half chaps, then two paddock boots, then the breeches, to allow a user to strip down to a pair of shorts or capris to get relief from the heat while tending to the horse on a summer day. The present invention, wherein the breeches and half chaps are essentially combined, allows simple and quick removal without even removing the spurs, which are worn under the present garment.

Figure 7:
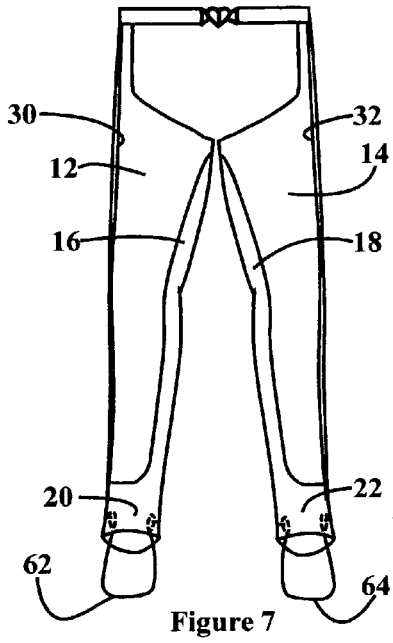
FIG. 7 is a front view of the lower body garment of the present invention.

The present invention is advantageous over the prior art in a number of respects. First, the inclusion of the gripping, protective fabric 16, 18 from the inner thigh to ankle eliminates the need for half chaps covering the portion of the rider's leg from ankle to knee. The gripping/protective fabric 16, 18 has flared sections 20, 22 near the bottom of the legs 12, 14 such that, in the most preferred embodiment of the present invention, the flared sections 20, 22 extend around the entire perimeter of the legs 12, 14 (see FIGS. 7 and 8). The flared sections 20, 22, insure that, if there is any twisting of the legs 12, 14 of the lower body garment 10 on the user's legs, the benefit of having the gripping, protective fabric between the rider's legs and the horse is not lost.

In a significant feature of the present invention, the legs 12, 14 are provided with a quick means for separation 30, 32. In the most preferred embodiment of the present invention, the quick means for leg separation 30, 32 comprises zippers 30, 32 positioned on and extending the length of the outer part of the leg, opposite the inner portion to which the gripping, protective fabric is secured. The quick means for separation 30, 32 allows a rider to quickly and easily remove the lower body garment 10 without requiring removal of the boots or any article of clothing. By comparison, the prior art breeches 110 required removal of, first, the spurs, then the half chaps 120, then removal of the boots 134, and pulling off the breeches 110 over the feet. The laborious task of removing the prior art breeches 110 and all that go with them to create the necessary uniform of an equestrian, made it inconvenient and uncomfortable to do so, but the alternative of leaving the padded breeches 110 and half chaps 120, 122 on created discomfort for the rider that is not riding, particularly those that are grooming, bathing, walking or running horses. The present invention resolves this problem and improves the comfort of the rider by making it quick and easy to remove the lower body garment 10.

Figure 8:
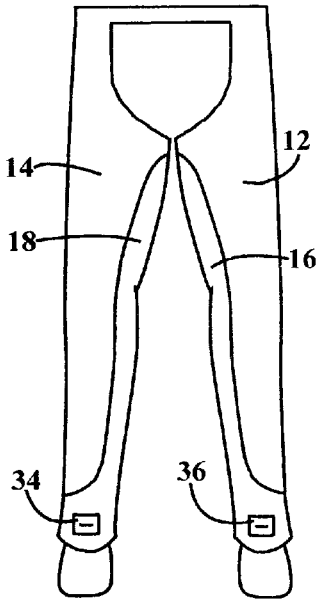
FIG. 8 is a rear view of the lower body garment of the present invention.
Figure 8A:
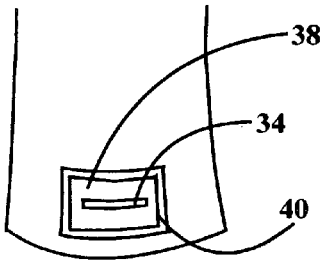
FIG. 8A is a detail view of the reinforced spur retaining provisions of the present invention.
Figure 9A:
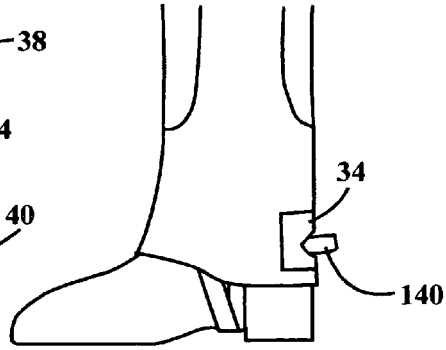
FIG. 9A is a detail view of the lower inner portion of a leg of the lower body garment of the present invention worn with a boot and spur.
Figure 9B:
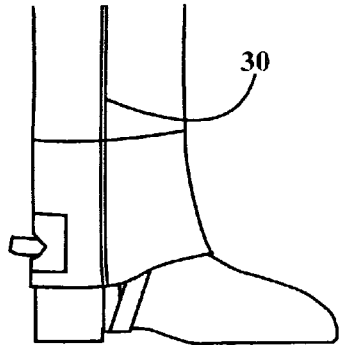
FIG. 9B is a detail view of the lower outer portion of a leg of the lower body garment of the present invention illustrating the zipper.
Figure 10:
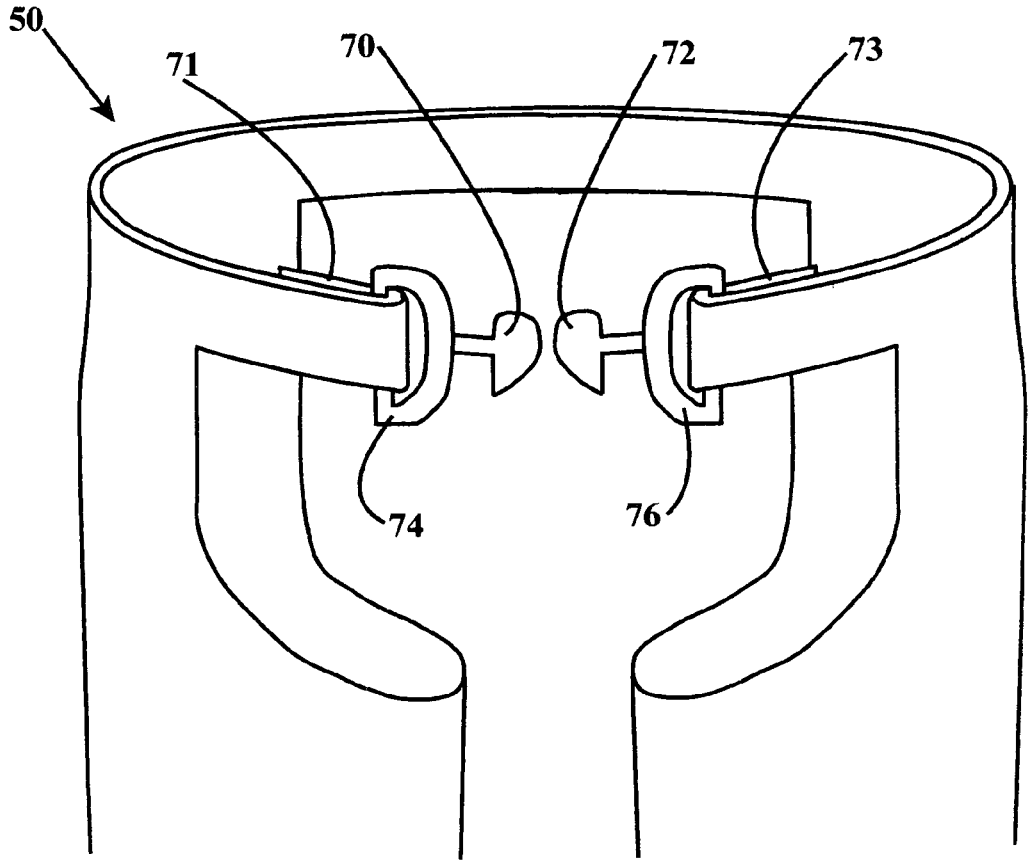
FIG. 10 is a detail view of the adjustable waistband of the lower body garment of the present invention.
Figure 11:
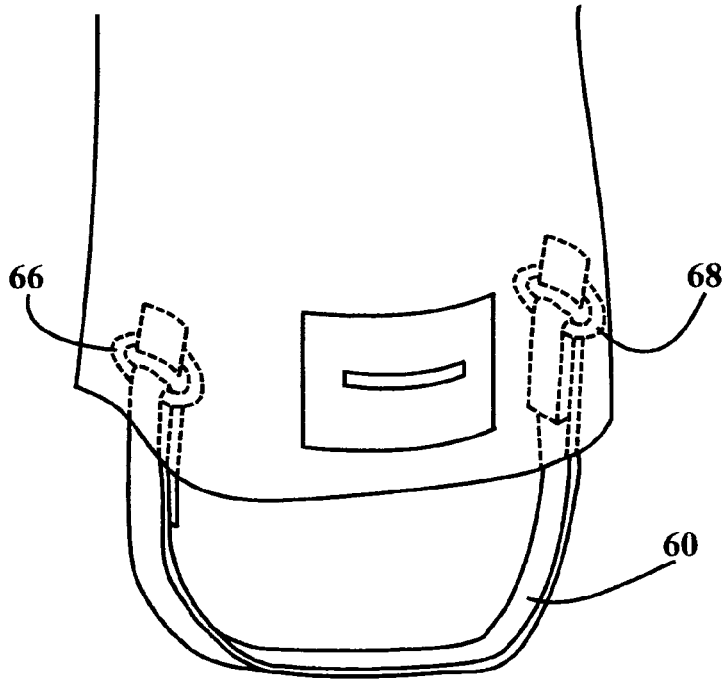
FIG. 11 is a detail view of the side and rear of the strap secured to the bottom of a leg of the lower body garment of the present invention.

The lower body garment 10 of the present invention is also distinguishable by a means for retaining the spur 144 comprising retaining slots 34, 36 (FIG. 8). The retaining slot 34 is formed in a reinforced fabric section 38 (see FIG. 8A), the section 38 being affixed along its perimeter 40 to secure the spur 144 therein. The provision of the spur retaining slots 34, 36 prevent the downward slipping of the spurs 144 depicted in FIG. 4B, and thus improves the safety and performance of the rider.

The inventive lower body garment 10 is also distinguishable by the inclusion of a quick connect, size adjustable waist 50 and straps 62, 64 that hold the legs 12, 14 down on the rider's legs. The straps 62, 64 are size adjustable by virtue of sections of hook and loop connectors mounted thereon. Specifically, two eyelets 66, 68 sewn onto the inner and outer portions of the legs 12, 14, along with the straps 62, 64 provide the means for attaching the straps 62, 64 to the legs 12, 14. The straps 62, 64 are easily adjusted, removed, discarded and replaced, so that as they wear out the lower body garment 10 is not affected.

The adjustable waistband 50 has a quick connect means and a waist size adjustment means. The waist size adjustment means is provided in the preferred embodiment by hook and loop connectors on extended overlapping waist tabs 71, 73, although other adjustable belt provisions are contemplated and do not depart from the principles of the present invention. The overlapping waist tabs 71, 73 retain buckle loops 74, 76 to which, in the preferred embodiment of the invention there are secured interlocking mechanical components 70, 72. The interlocking mechanical components 70, 72 provide a quick locking device coupling the waist together, and adjustment of the overlapping hook and loop connectors mounted on the extended tabs 71, 73 allows the size of the waist to be modified. Once properly adjusted, the waistband is quickly and simply clicked together to be snugly secured around the waist.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A lower body garment worn by an equestrian rider comprising:

two pant legs that cover the rider from waist to ankles, said two pant legs having gripping/protective sections of fabric sewn onto a 4 way stretch base layer of fabric along inner portions of said pant legs extending substantially uninterrupted the length from inner thigh to ankles of said pant legs.

2. The lower body garment set forth in claim 1 wherein said gripping/protective sections comprise padded gripping/protective sections having padding placed between gripping/protective fabric and said 4 way stretch base layer of fabric on each of the two legs of said garment.

3. The lower body garment set forth in claim 2 wherein said padded gripping/protective sections comprise sections of leather affixed to the inner portions of said two pant legs of said garment.

4. The lower body garment set forth in claim 3 wherein said padded gripping/protective sections comprise sections of ultrasuede affixed to the inner portions of said two pant legs of said garment.

5. The lower body garment set forth in claim 2 wherein said gripping/protective sections comprise flared sections extending around the perimeter of said two pant legs near the bottom of said two pant legs.

6. The garment as set forth in claim 5 further comprising means for quickly and easily affixing and removing said garment to a rider without requiring removal of the rider's boots, said means for quickly and easily affixing and removing further comprising means for quickly and easily affixing and removing said garment around a rider's waist and means for quickly and easily affixing and removing said garment along the lengths of the rider's legs.

7. The lower body garment set forth in claim 6 wherein said means for quickly and easily affixing and removing said garment around a rider's waist further comprises waist size adjustment means comprising hook and loop connectors on extended overlapping waist tabs.

8. The lower body garment set forth in claim 7 wherein said means for quickly and easily affixing and removing around a rider's waist comprises buckle loops retained by said overlapping waist tabs, said buckle loops further secured to a quick locking device comprising interlocking mechanical components.

9. The lower body garment set forth in claim 6 wherein said means for quickly and easily affixing and removing comprises means for quickly and easily affixing and removing along the lengths of said pant legs opposite the inner portions of said legs to which the gripping, protective fabric is secured.

10. The lower body garment set forth in claim 9 wherein said means for quickly and easily affixing and removing along the lengths of the rider's legs comprises zippers positioned near the outside of the rider's legs.

11. The lower body garment set forth in claim 1 further comprising spur retaining slots formed in reinforced fabric sections affixed near the bottom rear of each of said two pant legs.

12. The lower body garment set forth in claim 1 further comprising removable instep straps having hook and loop connectors mounted thereon such that said straps engage eyelets sewn into inner and outer portions of said two pant legs such that said inset straps are easily removed, discarded and replaced.

13. The lower body garment set forth in claim 12 wherein said inset straps are size adjustable by virtue of said hook and loop connectors.

* * * * *